United States Patent [19]

Reynolds

[11] 4,086,902

[45] May 2, 1978

[54] TOY PROJECTILE LAUNCHING APPARATUSES

[75] Inventor: John Dudley Reynolds, New Malden, England

[73] Assignee: Lesney Products & Co. Limited, London, England

[21] Appl. No.: 786,619

[22] Filed: Apr. 11, 1977

[30] Foreign Application Priority Data

Apr. 13, 1976 United Kingdom ..... 15148/76

[51] Int. Cl.[2] ..... F41F 1/04

[52] U.S. Cl. ..... 124/61; 124/49; 124/64

[58] Field of Search ..... 124/26, 27, 29, 61, 124/64, 65, 70, 71, 72, 73, 74, 75, 76, 77, 50, 79, 49

[56] References Cited

U.S. PATENT DOCUMENTS

| | | | |
|---|---|---|---|
| 174,628 | 3/1876 | Hicks | 124/61 |
| 565,423 | 8/1896 | Beck et al. | 124/62 |
| 632,838 | 9/1899 | Jacobs | 124/62 |
| 706,399 | 8/1902 | Fifer | 124/29 |
| 1,260,013 | 3/1918 | Neats | 124/65 |
| 1,262,004 | 4/1918 | Beachy | 124/65 |
| 1,673,945 | 6/1928 | Littlefield | 124/26 |
| 3,219,022 | 11/1965 | Hagemeyer | 124/61 |
| 3,388,696 | 6/1968 | Hoverath et al. | 124/62 |
| 3,662,729 | 5/1972 | Henderson | 124/73 |

*Primary Examiner*—Richard T. Stouffer
*Attorney, Agent, or Firm*—Browdy and Neimark

[57] ABSTRACT

An apparatus for use in launching toy projectiles which comprises a piston or bellows having one side pneumatically connected to an operating mechanism and its opposite side arranged so as to be capable of launching a projectile from the apparatus when moved towards that projectile at a sufficient speed, the operating mechanism exhibiting a chamber whose size can be suddenly changed by squeezing, or a manual blow, or the release of a stressed spring, to alter the pneumatic pressure applied to the piston or bellows and displace it launchingly towards a projectile, the initial volume of the chamber preferably being rapidly restored to suck the piston or bellows back to substantially its initial position after each launching operation.

15 Claims, 4 Drawing Figures

TOY PROJECTILE LAUNCHING APPARATUSES

This invention relates to toy projectile launching apparatuses such, purely for example, as toy guns.

An object of the invention is the provision of a simple but effective apparatus of versatile usage that can be employed substantially by itself, or in combination with other parts, the apparatus being capable, if desired, of launching projectiles from a point that is remote from the location of the operator of the apparatus.

According to the invention, there is provided toy projectile launching apparatus comprising a pneumatically displaceable member, an operating mechanism in pneumatic connection with one side of said displaceable member, and means for so disposing a projectile relative to the opposite side of the pneumatically displaceable member that it will be launched from the apparatus as a result of pneumatic displacement of the member theretowards at an operative speed, the operating mechanism comprising a chamber which is substantially sealed, apart from its pneumatic connection to said member, and means tending to maintain the chamber at a predetermined volumetric size, but said chamber being capable of being suddenly changed in volume to vary the pneumatic pressure therein and cause said member to be pneumatically displaced towards a projectile appropriately disposed for launching.

Figures 1, 2:
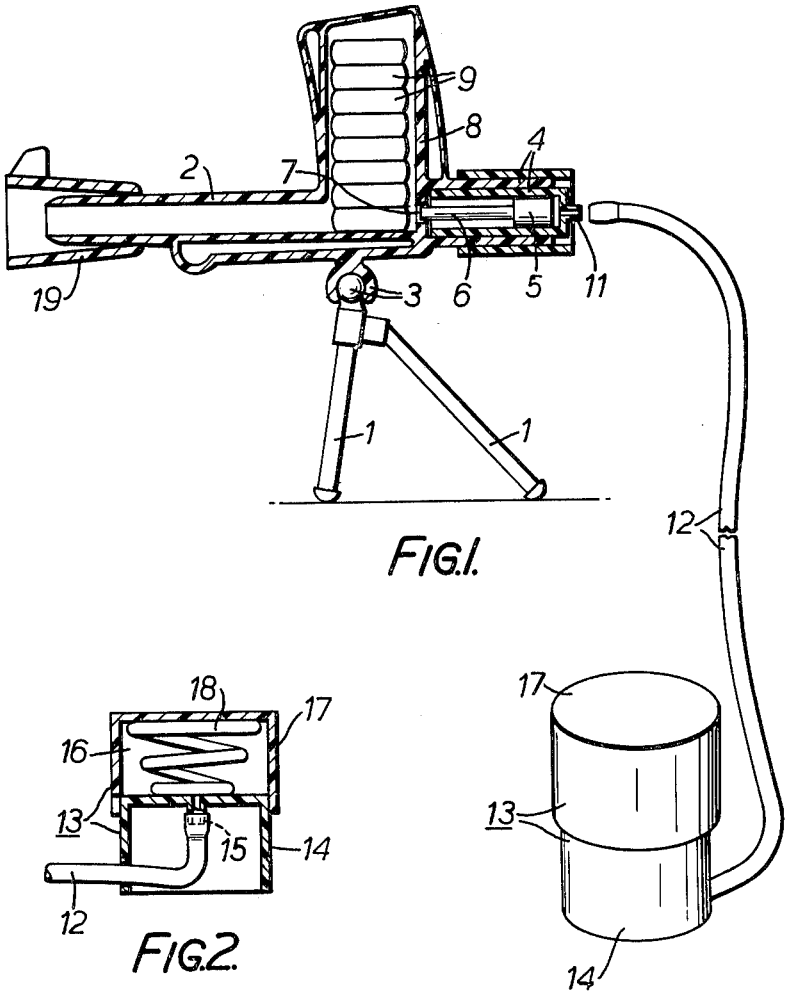
Figures 3, 4:
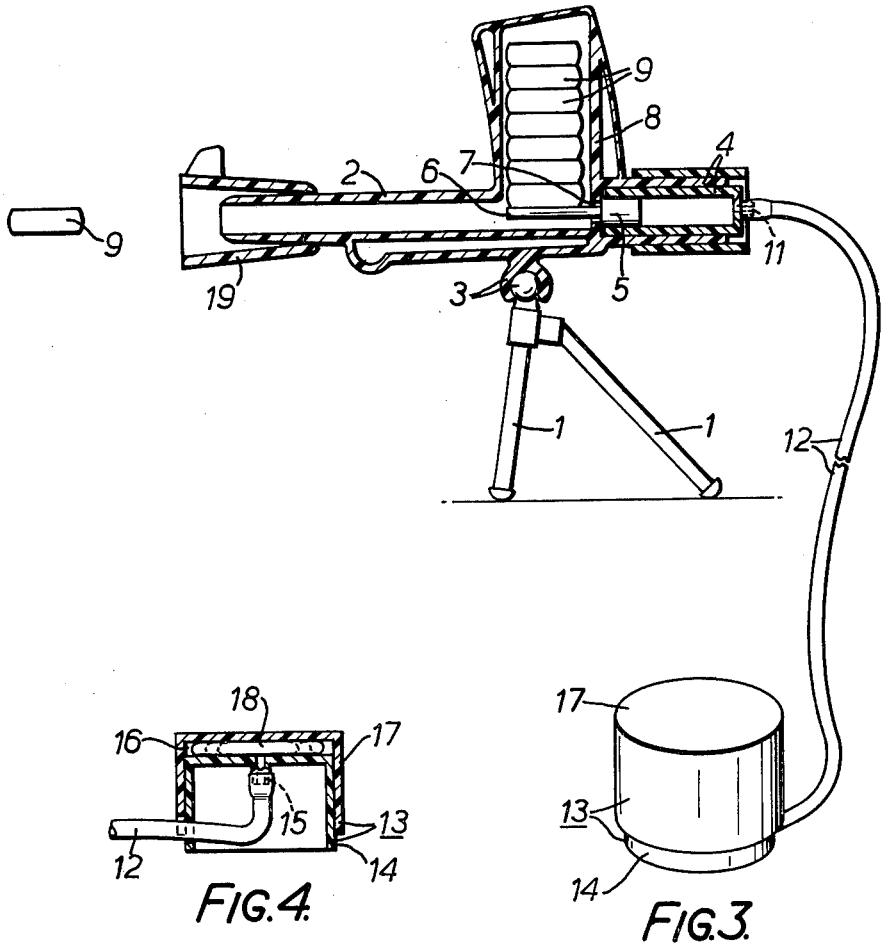

For a better understanding of the invention, and to show how the same may be carried into effect, reference will now be made, by way of example, to the accompanying drawings, in which:

FIG. 1 is a part-sectional side elevation of a toy gun in accordance with the invention in a condition in which it is ready to launch a projectile, FIG. 2 is a sectional elevation of operating mechanism of the toy gun of FIG. 1, FIG. 3 is a similar view to FIG. 1 but illustrates the toy gun as it launches a projectile, and FIG. 4 is a similar sectional view to FIG. 2 but illustrates the operating mechanism in the condition in which it is disposed in FIG. 3, i.e. at the instant of launching of a projectile.

Referring to the accompanying drawings, the toy that is illustrated as one example of a toy projectile launching apparatus to which the present invention can be applied is a repeat firing gun that comprises a tripod 1 or other stand upon which a gun body 2 is mounted, preferably in an adjustable manner. The gun body 2 can be adjustable in direction and elevation relative to the tripod 1 or other stand by interconnecting them with the aid of a ball and socket joint 3. One end of the gun body 2 is afforded principally by a cylinder 4 in which a pneumatically displaceable member in the form of a piston 5 is reciprocable substantially between the opposite ends of the cylinder. The piston 5 is a freely movable piston and one axial end thereof carries an axially projecting rod 6 that passes through a guide hole 7 formed in a wall of the body 2 between the cylinder 4 and the bottom of a magazine 8 for a plurality of identical projectiles 9. The cylinder 4 is formed as two relatively telescoped parts but, if preferred, the inner part (FIGS. 1 and 3) could be omitted and the guide hole 7 be formed in an initially separate washer subsequently pushed or glued into a position equivalent to that of the wall portion which exhibits the illustrated guide hole 7.

In the example which is being described, the magazine 8 projects substantially vertically upwards from the gun body 2 and is constructed to hold a plurality, such as ten, of the projectiles 9 stacked in superposed relationship. The magazine 8 may have an open top into which the projectiles 9 can be dropped or may have a cover (not shown) which is removable to obtain access to the interior of the magazine for re-loading purposes. If such a cover is provided, it may conveniently be formed from a synthetic plastics material having sufficient resiliency to enable it to snap into its magazine-closing position. It will be evident that the projectiles 9, which simulate shells or bullets, are fed into a launching position at the bottom of the magazine 8 by gravity with the construction that is illustrated by way of example in the accompanying drawings but this is not, of course, essential. A magazine may be releasably mounted to simulate a "clip" of ammunition and/or may be so disposed that projectiles contained therein are fed either substantially horizontally or upwardly into a launching position, one at a time, by a suitably stressed spring.

A location at the end of the cylinder 4 that is remote from the magazine 8 comprises a tubular connection 11 which is thus disposed at one axial side or end of the piston 5. The connection 11 projects beyond the cylinder 4 of the gun body 2 and is arranged to be coupled, preferably in a "push-on" manner, as illustrated, to one end of pneumatic connection means in the form of a flexible synthetic plastics or other tube 12 those length will be appropriate to the particular toy of which said tube 12 forms part. Although the pneumatic connection means will usually be flexible, it is envisaged that it could be substantially rigid in a toy in which the cylinder 4 and an operating mechanism 13 of the toy always occupy relatively fixed positions. The operating mechanism 13 for the toy gun that is being described by way of example comprises a cylindrical base member 14 that can stand upright upon any convenient substantially flat surface, said base member 14 having an opening in its curved wall through which the tube 12 projects and an internal downwardly orientated tubular coupling 15 which co-operates with the end of the tube 12 remote from the connection 11 preferably, but not essentially, in a "push-on" manner. The coupling 15 opens upwardly into a cylindrical chamber 16 that is formed inside a cylindrical plunger 17. The cylindrical plunger 17 is of substantially the same internal diameter as the external diameter of the base member 14 and it will be evident from the drawings that said plunger 17 is slidable upwardly and downwardly relative to the base member 14. Although a substantial seal exists between the internal curved surface of the plunger 17 and the external curved surface of the base member 14 which the former surrounds, it is by no means essential that an anywhere near perfect seal should exist and this, it will be realized, simplifies the construction and assembly of the operating mechanism 13 since measurements to very exact tolerances are not needed and the mechanism 13 will serve its intended purpose entirely satisfactorily provided only that the plunger 17 will slide upwardly and downwardly around the base member 14 with a substantial seal between the slidably engaging surfaces. The chamber 16 is, of course, of variable volume and it contains means to tend to maintain it at a predetermined maximum volumetric size, said means being in the form of an inverted frusto-conical spring 18. The plunger 17 may, as illustrated, be disconnectible from the base member 14 merely by sliding it upwardly to a sufficient extent but, if preferred, means may be provided to tend to prevent disengagement of the plunger 17 from the base member 14. This could, for example, be effected by anchoring the opposite ends of the spring 18 to the internal surface of the flat top of the plunger 17 and to the upper flat surface of the base member 14, respectively, but any other suitable means, such as a light check chain, could equally well be employed.

FIG. 1 of the drawings illustrates the toy gun in a condition in which it is ready to launch one of the projectiles 9, the magazine 8 being full. The piston 5 is disposed alongside the tubular connection 11 and the free end of the piston rod 6 lies in the guide hole 7 just clear of the bottom of the magazine 8 where the first and lowermost projectile 9 is ready for launching. Launching is achieved merely by striking the top of the plunger 17 a downwardly directed manual blow. The plunger 17 immediately moves downwardly relative to the base member 14 from substantially the position thereof that is illustrated in FIGS. 1 and 2 of the drawings to substantially the position thereof which is illustrated in FIGS. 3 and 4 of the drawings. The volume of the chamber 16 is thus suddenly reduced with a consequent sudden increase in the pneumatic pressure of the air contained within the chamber. Even if the substantial seal between the plunger 17 and the base member 14 is not particularly good, very little of the air trapped within the chamber 16 escapes during the fraction of a second in which the manually applied blow moves the plunger 17 downwardly relative to the base member 14. The chamber 16 is in open communication with the interior of the cylinder 4 by way of the tubular coupling 15, the tube 12 and the tubular connection 11 so that the sudden rise of pneumatic pressure which takes place within the chamber 16 also occurs throughout the length of the tube 12 and in the small space where the connection 11 opens against the axial side or end of the piston 5. The result is that the piston 5 moves very rapidly towards the end of the cylinder 4 that is remote from the connection 11, its rod 6 striking and launching the lowermost projectile 9 that is in its path. The launched projectile 9 thus issues from a simulated flaring cone 19 at the end of a barrel of the body 2 as illustrated in FIG. 3 of the drawings.

The spring 18 is compressed to substantially the condition illustrated in FIG. 4 of the drawings by the blow applied to the top of the plunger 17 but, as soon as the blow is over, the spring 18 tends to expand and restore the condition of the operating mechanism 13 that is illustrated in FIG. 2. The plunger 17 thus moves upwardly relative to the base member 14 and the pneumatic pressure in the chamber 16 drops. This has the result of sucking the piston 5 back towards the tubular connection 11 and, as soon as the piston rod 6 is withdrawn into the guide hole 7, gravity causes the stack of remaining projectiles 9 to drop downwardly in the magazine 8 to bring a fresh projectile to the launching position at the bottom of that magazine. It should, perhaps, be mentioned here that the guide hole 7 does not by any means fit sealingly around the piston rod 6 so that the left-hand end of the cylinder 4, as seen in FIGS. 1 and 3 of the drawings, is always in open communication with the surrounding air. A series of blows upon the top of the plunger 17 will cause the projectiles 9 to be launched one after the other and a quite rapid rate of launching repetition is possible with very little practice and can be achieved even by quite young children since no real skill is required, merely the ability to strike the top of the plunger 17 with a clenched fist or with the edge or flat of the hand. As soon as the magazine 8 is empty, the recovered projectiles 9 can be re-stacked therein, removing and replacing the cover, if provided. The toy gun is then again ready for use.

All or most of the parts of the toy gun that has been described can be formed from synthetic plastics materials although, if preferred, at least some of the parts may be formed by die casting metals. Although the piston 5 is free to move to and fro along the cylinder 4, it is desirable that it should make a reasonable seal against the internal curved surface of the cylinder 4 although it is emphasized that a perfect seal is not necessary. It is important for safety reasons that the projectiles 9 should not exhibit any sharp points and should not be formed from a heavy material because experience has shown that apparatus in accordance with the invention can launch a projectile at such a speed that it could cause injury if it were to exhibit a sharp point or sharp edge or to be of heavy formation. The danger of injury to the eye of a child would be significant under such circumstances but the danger is almost completely removed provided that the projectiles 9 are designed with such danger in mind.

Clearly, the toy gun that has been described and that is illustrated in the accompanying drawings is only one example of a number of toys to which the invention can be usefully applied. Toy mortars, rocket launchers, howitzers, cannons, and the like can all be constructed in accordance with the present invention and the apparatus is particularly useful in simulated battle scenes where toy projectiles of various kinds can be caused to strike "targets" and trigger the collapse or disintegration of such "targets." It is by no means essential that apparatus in accordance with the invention should be stationary during its use. The apparatus could, for example, form part of a toy vehicle such as a tank, gun carrier or mobile rocket launcher in which case the tube 12 could advantageously extend flexibly between the toy vehicle and a hand-held control console which also comprised means for supplying power to a driving motor together with means for steering the toy vehicle. Under such circumstances, the described operating mechanism 13 could be re-designed for operation by a sudden squeezing action rather than a manual striking action. A squeezable bellows or bulb could be substituted for the particular operating mechanism 13 that has been described without disadvantage. In addition to toy land vehicles, apparatus in accordance with the invention could also be used for launching projectiles from the guns of toy warships and the like and can be incorporated in toy human figures to enable such figures to fire simulated revolvers, rifles, machine guns and the like. Although the invention is particularly suitable for the launching of a series of projectiles at a rapid rate, it is not, of course, essential that a plurality of projectiles should be provided and apparatus in accordance with the invention may be constructed so that it can launch only a single projectile before some form of re-loading is necessary. Moreover, a battery of similar or identical apparatuses in accordance with the invention could be incorporated into a single toy.

Although it is preferred to employ a piston, such as the piston 5, as the pneumatically displaceable member, this is not essential and a bellows could be substituted for the described piston 5 and co-operating cylinder 4. Under these circumstances, the side of the bellows remote from the operating mechanism 13 would carry the rod 6 or an equivalent projectile-engaging element whilst the opposite side thereof would be in pneumatic connection with the mechanism 13 by way of the tube 12 or some other passage. The provision of the flexible tube 12 or an equivalent rigid tube is not, of course, essential since some toys will be so constructed that the cylinder 4 or a space abutting a bellows will be in direct pneumatic connection with the operating mechanism 13. It is also noted that, whilst a toy has been described in which the chamber 16 of the mechanism 13 tends to be maintained at a maximum volumetric size by the spring 18, a converse arrangement would be equally satisfactory in some toys with the spring 18 stressed to tend to reduce the chamber 16 in size to a minimum volume. A trigger or other release mechanism would then co-operate with the spring 18 to enable said spring to be freed from restraint to cause the required sudden reduction in volumetric size of the chamber 16.

The invention has, so far, been described only in relation to the launching of toy projectiles that simulate bullets, shells, mortar bombs and the like. The invention is not, however, limited solely to such toys and has many other general uses in a variety of different toys. Purely for example, apparatus in accordance with the invention can be employed in an automatic counting device and as a feed mechanism for displaceable items in a number of toys. Accordingly, it is emphasised that the invention includes the use of the described and illustrated apparatus, suitably modified, in toys of many different kinds.

I claim:

1. A rapid fire toy projectile launching apparatus, comprising:

pneumatically displaceable means for moving from an initial position toward a projectile, appropriately disposed for launching upon being struck by said pneumatically disposable means, when a positive pneumatic pressure is supplied thereto and for returning to the initial position thereof when a negative pneumatic pressure is supplied thereto;

support means for causing a projectile to be disposed, relative to the initial position of said pneumatically displaceable means, in a launchable position at which the projectile will be struck by said pneumatically displaceable means upon pneumatic displacement from the initial position thereof; and operating means, in pneumatic connection with said pneumatically displaceable means, for supplying positive pressure to said pneumatically displaceable means for forward movement thereof and for supplying negative pressure thereto for return movement thereof, said operating means comprising a variable volume chamber which is substantially sealed other than a pneumatic connection to said pneumatically displaceable means; and biasing means for maintaining said chamber at an initial volume thereof and for rapidly restoring the initial volume of said chamber after any sudden reduction in the volume thereof, whereby a sudden reduction in the volume of said chamber causes positive pressure to be supplied to said pneumatically displaceable means and the rapid return of said chamber to the initial volume thereof by means of said biasing means causes negative pressure to be supplied to said pneumatically displaceable means.

2. Apparatus according to claim 1, wherein said pneumatically displaceable means is a free piston arranged reciprocably in a co-operating cylinder.

3. Apparatus according to claim 2, wherein on side of said free piston carries a projectile-engaging element.

4. Apparatus according to claim 3, wherein said projectile engaging element is a rod that is entered non-sealingly and displaceably through a guide hole in said cylinder.

5. Apparatus according to claim 1, wherein said operating means further includes an elongated tube comprising the pneumatic connection between said chamber and said pneumatically displaceable means.

6. Apparatus according to claim 5, wherein said tube is of flexible formation.

7. Apparatus according to claim 1, wherein said operating means includes a base member and a plunger which co-operates slidably therewith to define said chamber.

8. Apparatus according to claim 7, wherein the co-operation between said base member and said plunger is such as to produce only a substantial, rather than perfect, pneumatic seal therebetween.

9. Apparatus according to claim 7, wherein said biasing means is a spring arranged to tend to maintain the initial volume of said chamber at a maximum value.

10. Apparatus according to claim 7, wherein said operating means further includes disengagement preventing means for preventing disengagement of said plunger from said base member.

11. Apparatus according to claim 1, wherein said support means includes a magazine for a plurality of projectiles.

12. Apparatus according to claim 11, wherein said magazine is substantially vertically arranged in such a position that superposed projectiles therein will be successively fed by gravity into said launchable position.

13. Apparatus according to claim 1 and taking the form of a repeat firing toy gun.

14. Apparatus according to claim 13, wherein the gun includes a stand and a body that is adjustable in position relative to said stand.

15. Apparatus according to claim 14, wherein said body and said stand are interconnected by a ball-and-socket joint.

* * * * *